US012195958B2

(12) United States Patent
Wolf

(10) Patent No.: US 12,195,958 B2
(45) Date of Patent: Jan. 14, 2025

(54) SYSTEM FOR PRODUCING ROOM ELEMENTS SUCH AS WALLS

(71) Applicant: Johannes Wolf, Tägerwilen (CH)

(72) Inventor: Johannes Wolf, Tägerwilen (CH)

( * ) Notice: Subject to any disclaimer, the term of this patent is extended or adjusted under 35 U.S.C. 154(b) by 127 days.

(21) Appl. No.: 17/791,483

(22) PCT Filed: Jan. 8, 2021

(86) PCT No.: PCT/EP2021/050266
§ 371 (c)(1),
(2) Date: Jul. 7, 2022

(87) PCT Pub. No.: WO2021/140198
PCT Pub. Date: Jul. 15, 2021

(65) Prior Publication Data

US 2023/0081024 A1 Mar. 16, 2023

(30) Foreign Application Priority Data

Jan. 9, 2020 (DE) ..... 10 2020 100 374.9

(51) Int. Cl.

| | |
|---|---|
| ***E04B 2/08*** | (2006.01) |
| ***E04B 2/16*** | (2006.01) |
| ***E04B 2/26*** | (2006.01) |
| ***E04C 2/12*** | (2006.01) |
| *E04B 2/02* | (2006.01) |

(52) U.S. Cl.
CPC ..... *E04B 2/08* (2013.01); *E04B 2/16* (2013.01); *E04B 2/26* (2013.01); *E04C 2/12* (2013.01); *E04B 2002/0245* (2013.01); *E04B 2002/0247* (2013.01)

(58) Field of Classification Search
CPC ..... E04B 2/04; E04B 2/08; E04B 2/06; E04B 2/14; E04B 2/16; E04B 2/26; E04B 2002/0245; E04B 2002/0247
See application file for complete search history.

(56) References Cited

U.S. PATENT DOCUMENTS

2019/0390452 A1 12/2019 Baker

FOREIGN PATENT DOCUMENTS

| | | | |
|---|---|---|---|
| AU | 6652681 | A | 6/1982 |
| DE | 4301222 | A1 | 7/1994 |
| DE | 9419703 | U1 | 2/1995 |
| DE | 29914261 | U1 | 1/2001 |
| DE | 202014008049 | U1 | 2/2015 |
| DE | 102017011331 | A1 | 11/2018 |
| EP | 0606633 | A2 | 7/1994 |
| EP | 1882788 | A2 | 1/2008 |
| EP | 2995736 | B1 | 6/2018 |
| GB | 2140053 | A | 11/1984 |

OTHER PUBLICATIONS

DE Office Action dated Sep. 15, 2020 as received in Application No. 102020100374.9.
International Search Report dated Mar. 29, 2021 as received in Application No. PCT/EP2021/050266.
EP Office Action dated Mar. 6, 2024 as received in Application No. 21701889.4.
GE Office Action dated Jun. 18, 2024 in application 10 2020 100 374.9.

*Primary Examiner* — Mark R Wendell
(74) *Attorney, Agent, or Firm* — Maschoff Brennan

(57) ABSTRACT

In a system for producing room elements, in particular walls, from individual construction elements, in particular made of wood, which are connected to one another to form the room element, at least four construction elements have different forms but are adapted to one another in terms of their dimensions. To this end, construction elements made of solid material are provided and construction elements consisting of hollow elements, into which an insertion frame is inserted. The construction elements are interconnected by means of pins, which are fastened in holes in the interior of the construction elements.

11 Claims, 5 Drawing Sheets

SYSTEM FOR PRODUCING ROOM ELEMENTS SUCH AS WALLS

TECHNICAL FIELD

Figure 1:
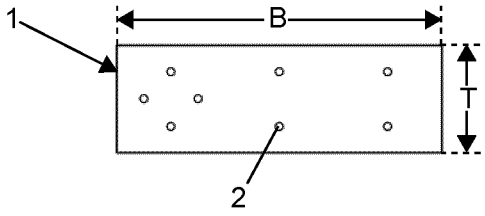

The invention relates to a system for manufacturing room elements, in particular walls, from individual components, in particular wood, which are connected to one another to form the room element, and a corresponding method.

PRIOR ART

There is a wide range of room elements, which are composed of individual building elements. First, of course, these include room walls or dividers in the private, public or even industrial sector. Especially in the latter area, a large number of open offices are separated from each other by a large number of room elements. However, room elements also exist for individual stores or department stores where products are offered in such room elements. The present invention is intended to cover all possible room elements.

The DE 195 21 990 C2 shows a room cell module for creating a building from several such modules, with floor, wall and ceiling elements consisting of wood, which form an essentially cuboid module structure that is transportable as a whole, wherein at least the floor element consists of one or more intrinsically stable multi-layer solid wood panels.

The DE 20 2014 008 049 U1, for example, discloses a supporting structure for the construction of buildings with components from the timber construction sector, wherein the supporting structure consists of a plurality of individual wooden components. A load-bearing component of a supporting structure is a three-dimensional and force-locking supporting structure member which is formed from individual elements in a modular and compatible manner, is geometric according to a coordinate system and is formed from at least one horizontally arranged supporting plate and at least one vertically arranged support, wherein two horizontal supporting plates are spaced apart by at least four vertical supports and form a hollow body. However, this cannot be used to form room elements that have an attractive design, but rather to form load-bearing structures.

The WO 2014/173381 also generally refers to the field of building construction, the elements of which are made of wood and insulating materials. The load-bearing parts for the supporting structure of a building are assembled in an inventive skeleton construction method to form a modular supporting structure member made of wood. A load-bearing member can be installed in a dry and self-assembly manner at any time of the year, without the use of mortar and glue. A large number of these handy load-bearing elements, laid in stretcher bond, form the building walls of a shell construction, whereby the individual load-bearing elements are clad with an insulating element made of sheathing insulating brick. This creates a closed insulating layer on the outer wall in the composite system with the supporting structure element. The supporting structure member and the cladding insulating block, in conjunction with a connecting element, form the basis of a new type of construction system.

However, the closest prior art is considered to be the applicant's own EP 2 995 736 B1. This shows a modular wooden wall system for the construction of solid partition walls and/or room dividers in buildings, wherein solid wood modules are connected to one another by means of connecting elements in a form-locking and/or force-locking manner and the connection of the solid wood modules is reversible. The solid wood module has at least two stepped channels which lie on a channel plane. A longitudinal edge length of the solid wood module is an integer multiple of a transverse edge length, and a distance of the channels from a longitudinal edge of the solid wood module is a quarter transverse edge length, and the distance of the channels on a channel plane in the transverse direction is a half transverse edge length. Here, the solid wood module shall have a square cross-section and a distance of a first channel plane from a transverse edge of the solid wood module shall be a half transverse edge length and the distance of the channel plane in the longitudinal direction shall be a transverse edge length, wherein the longitudinal edge of the solid wood modules faces substantially in the same direction as the grain direction of the wood from which the solid wood modules are made.

A disadvantage of this arrangement has been that the use of solid wood modules leads to the creation of very heavy wooden wall systems.

Object of the Invention

The objective of the present invention is to overcome the disadvantages of the prior art and, in particular, to create a system that can be used and is variable in a number of ways and can be considerably reduced in weight as well.

Solution of the Object

The features according to claim 1 lead to the solution of the object, wherein at least four components are designed differently but are matched to one another in their dimensions.

These four components are used to create any room elements. They include not only elements in a room, such as furniture, but also elements that make up the room itself, such as walls. They do not necessarily have to be arranged in a closed space or form a closed space, they can also form a decoration or afunctional element outside a room, for example in the garden, such as a wall for a barbecue. Many possibilities are conceivable here, which are encompassed by the present invention.

Advantageous embodiments are described in the dependent claims.

The entire system thus consists of a maximum of four components; of course, only two of the four components can be combined with each other. Of course, it is also conceivable to provide a larger number of components, but this complicates the formation of room elements.

The use of only one component made of solid material is already known from the prior art, in particular from the applicant's own EP 2 995 736 B1, so that no protection can be sought for this. However, the other three components are not known from the prior art, so that protection is sought for them. This applies, on the one hand, to the interaction of a hollow element with an insert skeleton and, on the other hand, in particular to a novel skeleton element. If it is assumed that the base element is made of solid material and has a width, a height and a depth, the hollow element has only one outer frame, which has an inner space with an inner width, an inner height and an inner depth. The inner height corresponds to the height of the base element.

The insert skeleton is again to be cross-shaped, although other geometric structures are also conceivable from the present invention. They are also to be encompassed by the invention. However, the cross-shaped insert skeleton appears to be the simplest in handling. This insert skeleton has an outer width, which corresponds to the inner width of the above-mentioned inner space of the hollow element. It also has an outer depth corresponding to the inner depth of the hollow element. This enables this insert skeleton to be inserted into the hollow element or the interior of the hollow element, thus saving considerable weight compared to a solid wood element.

The fourth component is a skeleton element, which can be used independently. This is also preferably cross-shaped, but other geometric designs are also conceivable, depending on the customer's wishes. This skeleton element again has the width, height and depth of the base element, so that it can be combined with the base element and also the hollow element without difficulty.

The components can be connected to each other using any type of connecting element. These include in particular screws, nails, but also adhesives or the two elements of a Velcro fastener. Here, too, there should be no limit to the invention.

Preferred are pins, especially wooden pins, which are inserted into corresponding holes. A specific hole pattern is preferred here, so that the components can be combined with each other in any way, but this should also distinguish them from imitators in particular.

In a particularly preferred further development of the invention, the skeleton element is to be specially configured. The cross-shaped design of the skeleton element enables, for example, the insertion of shelves for receiving or holding corresponding objects, for example cosmetic articles, jewelry, etc. For this purpose, it has proved advisable to form corresponding grooves in two adjacent crossbars of this skeleton element, into which trays can be inserted. For example, these trays can be made of glass, which helps to visually improve the appearance of the entire room element. Such designed room elements can be used, for example, stores with particularly high-quality products, especially cosmetics, jewelry, etc. Above all, these components offer the possibility that they can be repeatedly assembled in different ways, so that a corresponding cosmetics or jewelry store can also give customers a visually different, appealing image. There is no limit to the present invention in the design of such room elements.

The cross-shaped design of the skeleton element also gives the option of arranging sound-absorbing material in the recesses, such as acoustic panels, felt or the like. However, they can also be filled with all kinds of other materials that perform specific desired functions, such as insulating materials. This makes it possible to keep the skeleton elements themselves relatively thin.

DETAILED DESCRIPTION OF THE FIGURES

Figure 2:
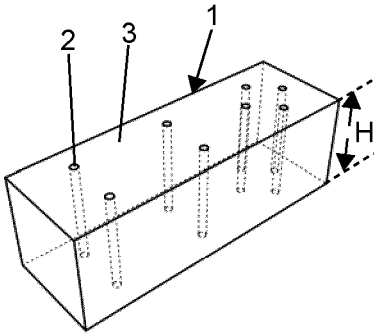
Figure 3:
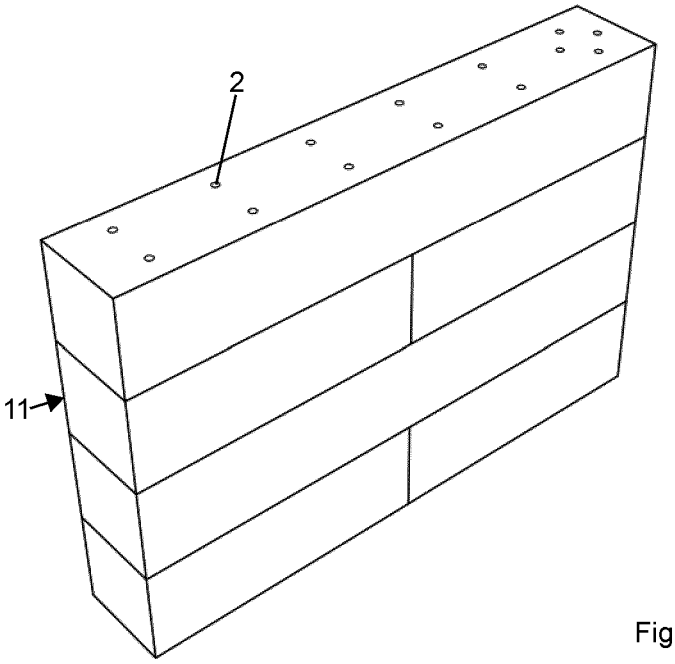
Figure 4:
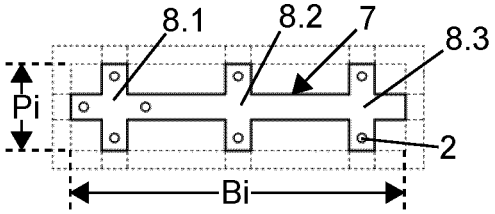
Figure 5:
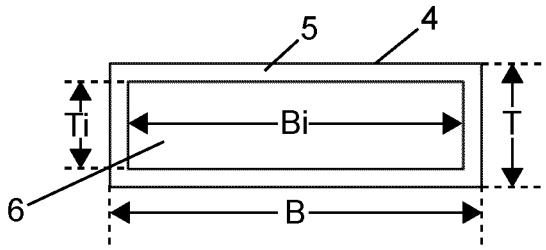
Figure 6:
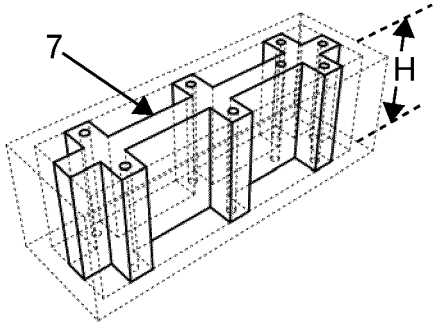
Figure 7:
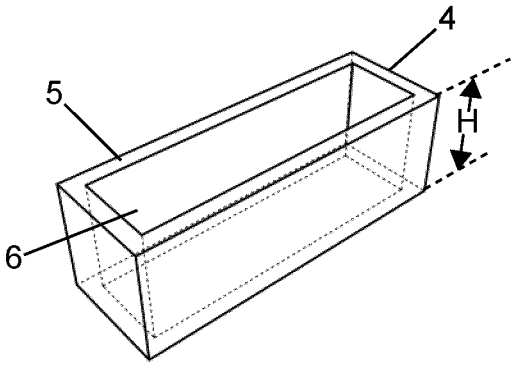
Figure 8:
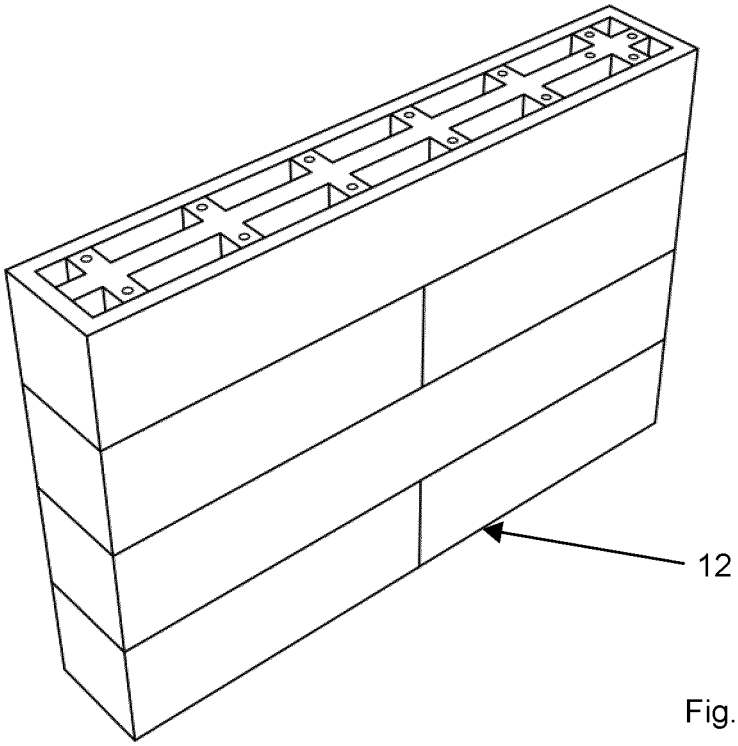
Figure 9:
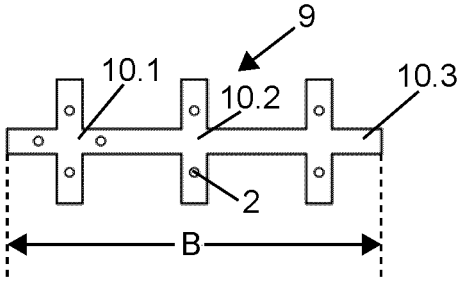
Figure 10:
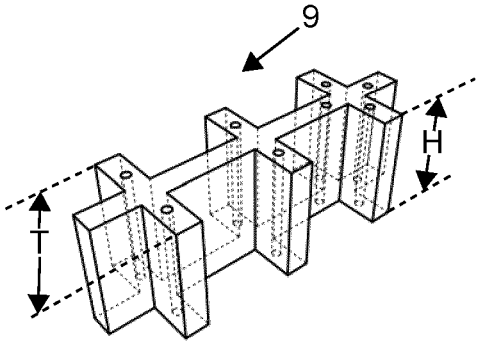
Figure 11:
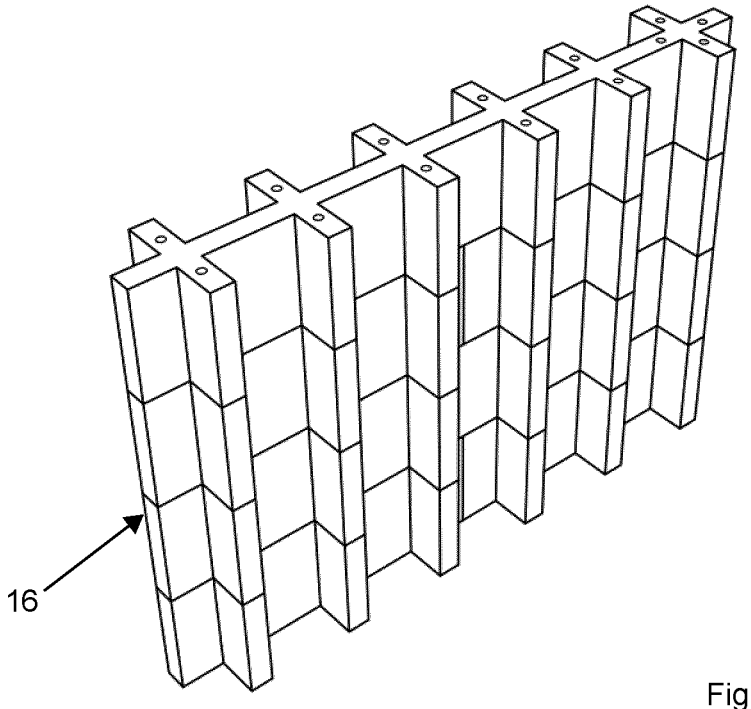
Figure 12:
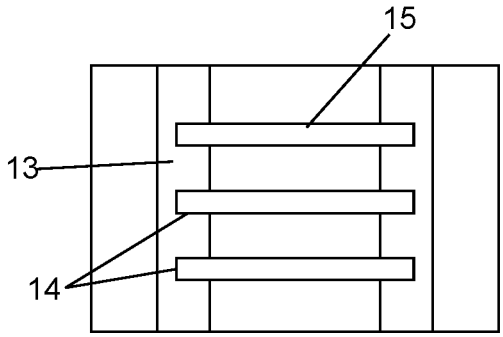
Figure 13:
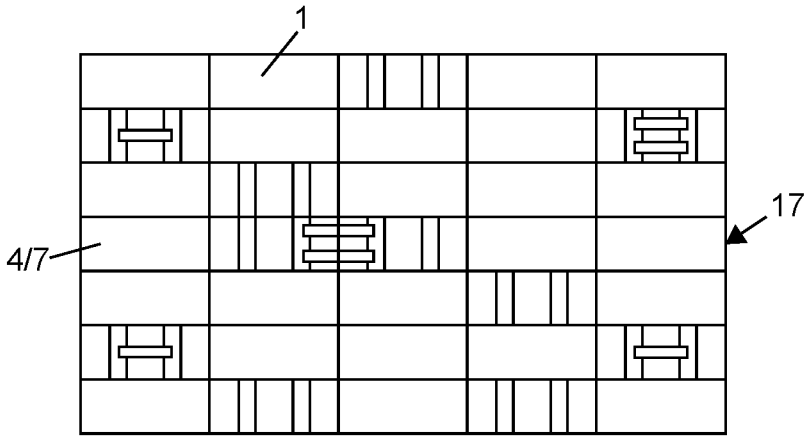

Further advantages, features and details of the invention result from the following description of preferred embodiment and from the drawing; these show in:

FIG. 1 a top view of a component comprising the system according to the invention;

FIG. 2 a perspective view of the component according to FIG. 1;

FIG. 3 a perspective view of a room element made of components according to FIG. 1;

FIG. 4 a top view of a further component of which the system according to the invention consists;

FIG. 5 a top view of a further component of which the system according to the invention consists, in particular in cooperation with the component according to FIG. 4;

FIG. 6 a perspective view of the component according to FIG. 4;

FIG. 7 a perspective view of the component according to FIG. 5;

FIG. 8 a perspective view of a room element made of components according to FIGS. 4-7;

FIG. 9 a top view of a further component making up the system according to the invention;

FIG. 10 a perspective view of the component according to FIG. 9;

FIG. 11 a perspective view of a room element made of components according to FIGS. 9 and 10;

FIG. 12 a side view of a further development of the component according to the invention as shown in FIGS. 9 and 10;

FIG. 13 a front view of a room element made of a plurality of different components.

EMBODIMENT

According to FIGS. 1 and 2, the system for producing room elements according to the invention has a base element 1. This is designed as a rectangular block and has a width B, a height H (see FIG. 2) and a depth T. These dimensions are coordinated with each other: The width is 450 mm, the height 150 mm and the depth 150 mm. As shown in FIG. 3, the dimensions could also be multiplied.

The base element consists of solid material, for example solid wood or corresponding glued wood layers. It also has a plurality of holes 2 into which pins, not shown in more detail, can be inserted, which then project partially beyond a surface 3 of the base element and can engage in further components placed on the base element 1. This creates a pin connection between the individual components.

The holes 2 form a hole pattern which is repeated in all components except the component shown in FIGS. 5 and 7. This simplifies precise assembly of the individual components to form the room element.

FIGS. 5 and 7 show a hollow element 4 which has an outer frame 5. This outer frame 5 has the outer dimensions of the base element 1, i.e., the width B, the height H and the depth T. It encloses an inner space 6, which has an inner width Bi, the height H and an inner depth Ti.

FIGS. 4 and 6 show an insert skeleton 7 which is cross-shaped. In the example, three crosses 8.1, 8.2 and 8.3 are integrally connected. The holes 2 mentioned above are located in the area of the crosses.

This insert skeleton 7 again has the height H, but it has an outer width that corresponds to the inner width Bi and an outer depth that corresponds to the inner depth Ti of the hollow element 4. This dimensioning ensures that the insert skeleton 7 can be inserted into the hollow element 4.

FIG. 8 also shows that the width of the hollow elements and the inner skeletons can multiply, in which case the crosses also multiply.

FIGS. 9 and 10 show a skeleton element 9 which, except for the dimensions, corresponds approximately to the insert skeleton 7. This skeleton element 9 also consists of crosses 10.1, 10.2 and 10.3, which are integrally connected to each other and again have the above-mentioned holes 2. Furthermore, the skeleton element 9 has the height H, but also has the width B and the depth T of the base element 1. This ensures that this skeleton element can be connected via corresponding pins to the base element 1 but also to the insert skeleton 7, which is inserted into a hollow element 4, for example.

The functioning of the present invention is as follows:

In an embodiment according to FIG. 3, a partition wall is to be formed whose surface appears smooth on the outside.

This partition wall 11 can be assembled from individual base elements 1 as desired by a customer. The anchoring in a floor is preferably also done by a pin connection or separately by any other known connection. This results in a neat partition wall which, however, has a relatively high weight as a result of the large number of base elements 1 made of solid material.

If it is now desired to create a wall 12 as shown in FIG. 8, which is lighter in weight but has a smooth surface, one or more or even all of the base elements are replaced by the hollow element 4, into each of which an insert skeleton 7 is inserted. The wall 12 shown there consists of the combination of hollow elements 4 and insert skeletons 7 to reduce weight.

However, these skeleton elements are visible from the outside, so they can visually give the wall 12 very unique appearance. This can be designed according to the customer's wishes.

A wall 16 consisting only of skeleton elements 9 is shown in FIG. 11. These skeleton elements 9 can now in turn be combined as desired with the base elements 1, the hollow elements 4 and the insert skeletons 7.

However, the skeleton elements 9 also make it possible to further improve the usability of the room element 12. In FIG. 12, it is indicated that grooves 14 can be formed in crossbars 13, into which trays 15 can then be inserted. For example, these can be glass trays which serve for the placement of any objects. In this way, for example, a cosmetics department of a department store can be designed, wherein the individual cosmetic articles can be placed on the trays 15 and thus better presented to the customer.

REFERENCE SYMBOL LIST

| | |
|---|---|
| 1 | base element |
| 2 | hole |
| 3 | surface |
| 4 | hollow element |
| 5 | outer frame |
| 6 | inner space |
| 7 | insert skeleton |
| 8 | cross |
| 9 | skeleton element |
| 10 | cross |
| 11 | partition wall |
| 12 | wall |
| 13 | crossbars |
| 14 | groove |
| 15 | shelve |
| 16 | wall |
| B | width |
| H | height |
| T | depth |
| Bi | inner width of 4 |
| Ti | inner depth of 4 |
| Ba | outer width |
| Ta | outer depth |

The invention claimed is:

1. A system for producing room elements, in particular walls, from individual components, in particular made of wood, which are connected to one another to form the room element, wherein an insert skeleton is inserted into at least one hollow element, wherein the at least one hollow element has an outer frame, which has an inner space with an inner width (Bi), a height (H) and an inner depth (Ti), wherein the insert skeleton has the inner width (Bi), the height (H) and the inner depth (Ti), wherein the insert skeleton is provided and is cross-shaped, wherein the hollow element and the insert skeleton are connected to one another via pins which engage in holes, wherein the holes are arranged in a hole pattern which is the same for the hollow element and the insert skeleton, wherein the insert skeleton has an outer width, the height (H) and an outer depth, wherein the outer width corresponds to the inner width (Bi) and the outer depth corresponds to the inner depth (Ti), wherein at least the hollow element or the insert skeleton has receptacles for trays, wherein at least four components are of different design but are matched to one another in their dimensions.

2. The system according to claim 1, wherein at least one component is insertable into another component.

3. The system according to claim 2, wherein a base element is made of solid material and has a width (B), the height (H) and a depth (T).

4. The system according to claim 1, wherein a base element is made of solid material and has a width (B), the height (H) and a depth (T).

5. The system according to claim 1, wherein a skeleton element is provided and this is cross-shaped.

6. The system according to claim 5, wherein the skeleton element has a width (B), the height (H) and a depth (T).

7. The system according to claim 1, wherein the components are connected to one another via pins, which engage in holes.

8. The system according to claim 7, wherein the holes are arranged in a hole pattern which is the same for all components.

9. The system according to claim 1, wherein at least one component has receptacles for shelves.

10. The system according to claim 9, wherein a skeleton element has grooves between two crosses for inserting the shelves.

11. A method of producing room elements, in particular walls, from individual components made of wood, which are connected to one another to form the room element, wherein an insert skeleton is inserted into at least one hollow element, wherein the at least one hollow element has an outer frame, which has an inner space with an inner width (Bi), a height (H) and an inner depth (Ti), wherein the insert skeleton has the inner width (Bi), the height (H) and the inner depth (Ti), wherein the insert skeleton is provided and is cross-shaped, wherein the hollow element and the insert skeleton are connected to one another via pins which engage in holes, wherein the holes are arranged in a hole pattern which is the same for the hollow element and the insert skeleton, wherein the insert skeleton has an outer width, the height (H) and an outer depth, wherein the outer width corresponds to the inner width (Bi) and the outer depth corresponds to the inner depth (Ti), wherein at least the hollow element or the insert skeleton has receptacles for trays, wherein at least four components are of different design but are matched to one another in their dimensions and are connected to one another as desired in their arrangement to form the room element.

* * * * *